US006060125A

United States Patent [19]

Fujii

[11] Patent Number: 6,060,125

[45] Date of Patent: May 9, 2000

[54] METHOD AND APPARATUS FOR CONTROLLING OPENING AND CLOSING SPEED OF DISPENSING GUN VALVE MECHANISM

[75] Inventor: Hidetsugu Fujii, Tokyo, Japan

[73] Assignee: Nordson Corporation, Westlake, Ohio

[21] Appl. No.: 09/228,360

[22] Filed: Jan. 11, 1999

[30] Foreign Application Priority Data

Jan. 12, 1998 [JP] Japan ..... 10-016350

[51] Int. Cl.[7] ..... B05D 1/02

[52] U.S. Cl. ..... 427/421; 222/518; 239/585.5

[58] Field of Search ..... 427/421; 239/585.1, 239/585.5, 533.1, 533.15; 222/504, 518

[56] References Cited

U.S. PATENT DOCUMENTS

| | | | |
|---|---|---|---|
| Re. 29,495 | 12/1977 | Georgi | 222/1 |
| 3,742,713 | 7/1973 | Schweitzer | 60/325 |
| 4,465,212 | 8/1984 | Boone | 222/504 |
| 4,579,255 | 4/1986 | Frates et al. | 222/149 |
| 4,678,100 | 7/1987 | Gelines et al. | 222/52 |
| 5,076,501 | 12/1991 | Tschumi | 239/654 |
| 5,747,102 | 5/1998 | Smith et al. | 427/96 |

*Primary Examiner*—Diana Dudash
*Assistant Examiner*—Jennifer Calcagni
*Attorney, Agent, or Firm*—Wood, Herron & Evans, L.L.P.

[57] ABSTRACT

Dispensing apparatus including a dispensing gun having a gun body and a valve mechanism disposed in the gun body. The valve mechanism is operatively coupled to a piston mounted for reciprocating movement and the valve mechanism is operable between opened and closed positions for selectively dispensing liquid from the dispensing gun. A hydraulic actuator is operatively coupled to the piston for moving the piston by way of an output of hydraulic pressure. A flow control device is operatively coupled to the hydraulic actuator for regulating liquid flow from the hydraulic actuator and thereby controlling at least one of the opening speed and closing speed of the valve mechanism. A method of dispensing liquid in accordance with the disclosure includes holding a supply of pressurized liquid in a liquid passage of the dispensing gun, moving the piston under the force of hydraulic pressure to move the valve mechanism from the closed position to the opened position, and dispensing pressurized liquid from the gun.

16 Claims, 4 Drawing Sheets

METHOD AND APPARATUS FOR CONTROLLING OPENING AND CLOSING SPEED OF DISPENSING GUN VALVE MECHANISM

This application is being filed in accordance with 35 U.S.C. § 119 and claims the priority of Japanese Patent Application No. 10-016350 which is fully incorporated by reference herein.

1. Field of the Invention

The present invention pertains to a technique for using a dispensing gun having a valve mechanism to dispense and coat a liquid such as an adhesive, sealant, sealing agent, coating agent, etc. onto the surface of a substrate material in a linear manner from the nozzle of the aforesaid dispensing gun. Furthermore, the liquids used in the present invention include those made liquid by heating and melting, such as thermoplastic resins.

2. Background of the Invention

Dispense-coating is widely used at present in liquid crystal board manufacturing processes and in electronic board manufacturing processes, etc. A dispensing gun having a valve mechanism is moved relative to a substrate material which is being coated and, while this happens, a liquid such as an adhesive, sealant, sealing agent, coating agent, etc. is dispensed from the nozzle of the aforesaid dispensing gun and a line is drawn on the surface of the substrate material.

A known example of a dispensing gun apparatus having a valve mechanism and used in the aforesaid conventional liquid dispense coating method is the dispenser for dispensing small amounts of liquid disclosed in Examined Japanese Utility Model Application Hei 7-33907. This apparatus uses a solenoid actuator for the valve mechanism's opening and closing action, and its details are described in the aforesaid publication. This publication lacks an explanation of the substrate material which is being coated and the relationship between the substrate material and the dispenser, but the apparatus is constituted so that the dispenser and substrate material which is being coated can move relative to one another. For example, it is constituted so that the dispenser moves relative to the substrate material or so that the substrate material moves relative to the dispenser by means of a robot device, etc., which can move along the X axis and Y axis.

Another example is shown in FIG. 4, which shows an example which uses a pneumatic actuator for the valve mechanism's opening and closing action. That is, FIG. 4 shows the schematic of an apparatus for dispense-coating liquid with an air-operated dispensing gun 51 supplied by a liquid supply apparatus 52. A solenoid operated valve 53 turns the air on and off for operating dispensing gun 51, and solenoid operated valve 53 opens and closes according to a control signal from control apparatus 54. An air supply source 55 is connected to valve 53.

Dispensing gun 51 shown in FIG. 4 is constituted so that dispensing gun 51 and substrate material 56, which is being coated, can move relative to one another. Dispensing gun 51 moves relative to substrate material 56 or substrate material 56 moves relative to dispensing gun 51 using a robot apparatus, not shown, which can move along the X axis and Y axis. In a liquid dispense-coating apparatus constituted in this manner, when solenoid operated valve 53 receives a control signal from control apparatus 54 and opens, operating air from air supply source 55 is supplied to actuator part 51a of dispensing gun 51. When this happens, piston 57 is pushed upward against the pressure of spring 58. Needle 59, which constitutes the valve mechanism of gun 51, is directly linked to piston 57, so it is pulled upward at the same time and the valve mechanism opens.

Liquid supplied from liquid supply apparatus 52 is dispensed from nozzle 60 when needle 59 opens. This liquid 61 is dispensed onto substrate material 56, which is moving relative to dispensing gun 51. When coating ends, solenoid operated valve 53 is switched by the control signal from control apparatus 54, and the air pressure pushing piston 57 upward is released and becomes atmospheric pressure. Thus, piston 57 is pushed downward by the force of spring 58, and needle 59 closes the valve mechanism and dispensing of liquid stops.

FIG. 5 shows the liquid coating pattern and the opening and closing action of the valve mechanism in a linear liquid coating pattern using the dispenser for dispensing small amounts of liquid disclosed in the aforesaid Examined Utility Model Application Hei 7-33907 and the dispensing gun shown in FIG. 4. That is, FIG. 5 is a model drawing showing the relationship between valve mechanism opening and closing action 62 and coating pattern 61. The X axis in the drawing is time, so the lower line indicates the valve mechanism's opening and closing action 62. Synchronized with this and above it is liquid coating pattern 61. Of course, this drawing is enlarged and exaggerated in a model fashion, so it is not surprising that an actual liquid coating pattern 61 would have an extremely narrow line width H of about 50 to 150 microns. As is clear from FIG. 5, the valve mechanism is open from the start of coating until the end of coating in a conventional coating method, and the drawing shows that at coating end point A the coating amount suddenly increases and the line width widens.

The liquid coating method described above has the following types of problems. The first problem, as shown in FIG. 5, is that there is a sudden increase in the coating amount at coating end point A. This makes the line width of coating end point A three to five times wider than the normal coating pattern line width H, and this leads to a decrease in product quality. For example, when applying an adhesive or spacer to glue liquid crystal glass, there is too much adhesive only at the coating end point area, so the glass substrate'scombined thickness is thick just at that area, or the adhesive oozes out to the surrounding area, and quality decreases. This is a case in which the relative motion speed of the dispensing gun and substrate material is rigidly kept at a constant speed from coating start until coating finish. The reason for this is that the closing speed of the dispensing gun valve mechanism at the coating end point is fast—from 500 to 1000 mm/sec—as the needle is pressed down, so the needle acts like a piston pump and the liquid in the nozzle part is pushed out in one stroke.

A second problem is that a bubble 63 often occurs near coating start point B. This is readily apparent when coating with a material which contains dissolved oxygen, such as a UV curing resin, etc. The main cause is that, when coating starts, the needle of the dispensing gun is pulled upward at high speed, as described previously, so the liquid pressure of the coating solution at the needle tip temporarily has negative pressure, and this results in cavitation, and the dissolved oxygen forms tiny bubbles. These bubbles accumulate and gradually become larger, and the bubbles appear at the coating surface without being destroyed. Experience shows that bubble 63 has a diameter of about 100 $\mu$m.

Bubble 63 appears conspicuously near dispensing start point B, and stops occurring as dispensing continues and becomes stable. If this sort of phenomenon occurs during adhesive coating when gluing disks in the DVD (digital video disk) manufacturing process, for example, it causes crucial problems when writing data to a DVD or when reading the data.

A third problem accompanies the trend to high-function robots, etc., and is a problem which occurs in a coating operation while the relative motion speed of dispensing gun 51 and substrate material 56 is undergoing variable speed control. The width of the coating line becomes narrow when the relative motion speed is fast, and the width of the coating line becomes broad when the relative motion speed is slow.

The inventor and others believed that the aforesaid first and second problems—that is, the sudden increase in dispensing amount at the coating end point and the formation of bubbles at the coating start point—were caused by the suddenness of the speed of the opening action and closing action of the valve mechanism (that is, the needle of the gun), so they could be solved if the speed of the opening action and closing action were slowed to some extent. However, the result of experiments found that with solenoid actuators and pneumatic actuators it was nearly impossible to adjust the operating speed. That is, in the case of solenoid actuators, even if the voltage or current values are varied, when the excitation force exceeds a threshold value the actuator's iron core operates in one stroke from start point to stop point. Also, the air in pneumatic actuators is compressible, so even if the air pressure is changed gradually, when the action start pressure is exceeded it operates in one stroke from piston start point to stop point. The third problem—variation in coating line width when coating while relative motion speed undergoes variable motion—could be solved by controlling the valve mechanism'sextent of opening in proportion to the motion speed and variably controlling the dispensing amount, but in solenoid actuators and pneumatic actuators this sort of control—that is, causing tiny actions—is impossible.

SUMMARY OF THE INVENTION

The present invention is one which takes into account the aforementioned problems. In one aspect, the invention pertains to a method for dispense-coating the surface of a substrate material with liquid from a liquid dispense-coating apparatus constituted so that a dispensing gun and a substrate material undergo relative motion. One object is to provide a liquid coating technique which prevents widening of the coating line width due to a sudden increase in coating amount at the coating end point. Another object is to prevent the formation of bubbles near the coating start point. Yet another object is to make the coating line width constant even when the relative motion speed of the dispensing gun and substrate material undergoes variable speed control.

To achieve the various advantages of this invention, the opening and closing action of a dispensing gun valve mechanism is performed by a hydraulic actuator. A flow control device is provided in a liquid pressure supply circuit including the hydraulic actuator, and the liquid flow is controlled by regulating the flow control device to thereby control the opening speed and/or closing speed of the valve mechanism.

The present invention also contemplates a speed control apparatus for a liquid dispensing gun valve mechanism wherein the speed control apparatus includes a hydraulic actuator. Also in accordance with the invention, a flow control device is provided in a liquid pressure supply circuit including the hydraulic actuator, and the liquid flow is controlled by regulating the flow control device to thereby control the opening speed and/or closing speed of the valve mechanism.

Additionally, the present invention contemplates a method for dispense-coating the surface of a substrate material with liquid from a valve mechanism operated by a control apparatus similar to that described above, and further constituted so that the opening and closing speed of the valve mechanism is controlled by regulating the flow control device. The liquid supply amount of the hydraulic actuator is controlled in proportion to a relative speed of movement between the dispensing gun and the substrate material, and further coats the substrate with liquid while regulating the extent that the valve mechanism is open.

As mentioned above, the present invention generally relates to the act of opening and closing a liquid dispensing valve mechanism with a hydraulic actuator. Liquids are generally incompressible, so their volume does not change even after the application of pressure. Therefore, the speed of the hydraulic actuator is proportional to the liquid supply speed to the hydraulic actuator. The liquid flow can be controlled by providing a flow control device in the liquid pressure supply circuit supplying the hydraulic actuator and regulating the flow control device, and the aforesaid dispensing gun valve mechanism opening and closing speed can be controlled.

Before an actual coating operation takes place according to a preferred embodiment of the invention, a number of tests are carried out to match coating parameters such as the physical properties of the coating liquid and to empirically determine the valve mechanism opening speed at which bubbles do not form at the coating start point and the valve mechanism closing speed at which there is not a sudden increase in dispensing amount at the coating end point. By adjusting and setting the aforesaid flow control device to match this speed it is possible to prevent the formation of bubbles at the coating start point and to prevent a sudden increase in dispensing amount at the coating end point.

Furthermore, by using an incompressible liquid it is possible to adjust the extent to which the valve mechanism opens. That is, the amount of movement of the hydraulic actuator is proportional to the volume of liquid supplied to the hydraulic actuator, so by controlling the volume of liquid supplied to the hydraulic actuator it is possible to adjust the extent to which the valve mechanism opens. This makes it possible to freely regulate the amount of liquid dispensed from the dispensing gun, and this is a major benefit. That is, by regulating the extent of opening of the valve mechanism in proportion to the relative motion speed of the dispensing gun and substrate material it is possible to maintain a constant coating line width even if the relative motion speed of the dispensing gun and substrate material varies.

DETAILED DESCRIPTION OF THE PREFERRED EMBODIMENTS

Figure 1:
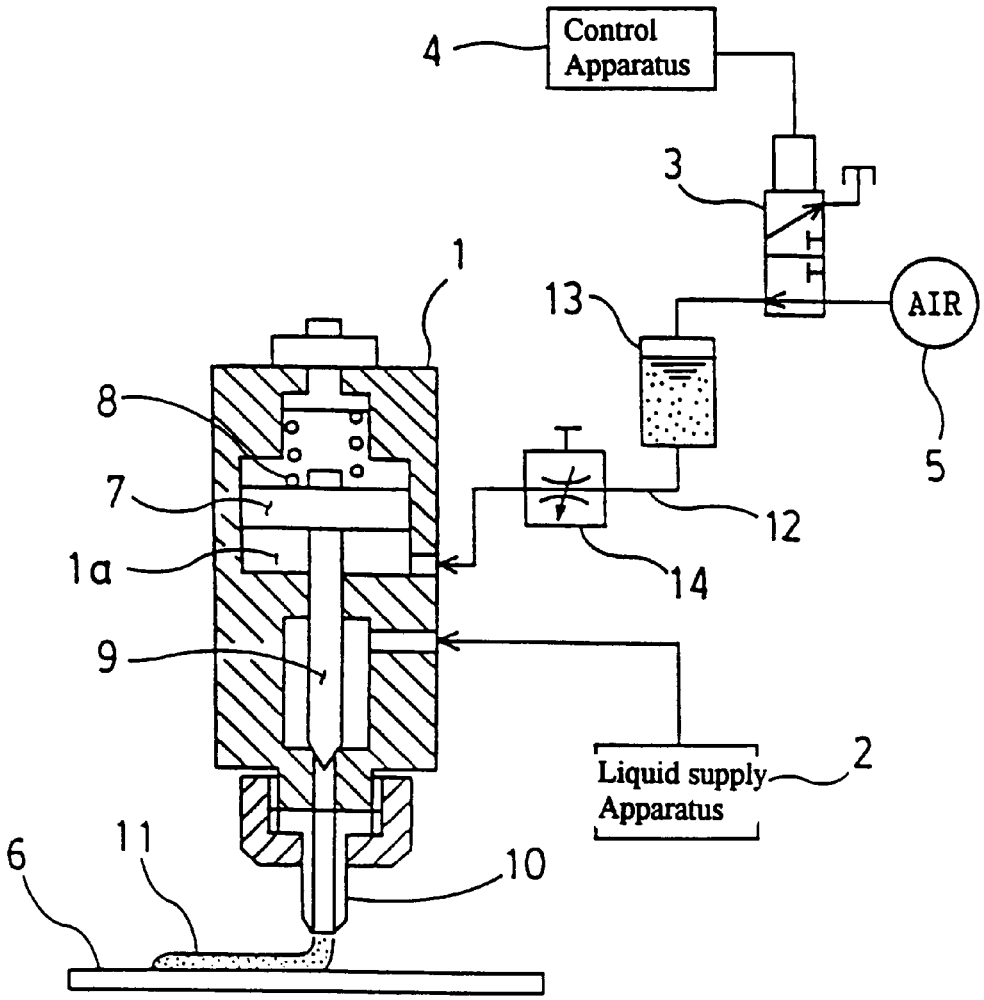
FIG. 1 is a schematic, partially cross-sectioned view of a first embodiment of the present invention.

In the first embodiment shown in FIG. 1, a cylinder unit 1*a*, which constitutes a hydraulic actuator, is provided in a dispensing gun 1, and a piston 7 is housed inside cylinder unit 1*a*. A liquid supply apparatus is connected to dispensing gun 1. A solenoid operated valve 3 controls primary on/off air for opening and closing dispensing gun 1. Solenoid operated valve 3 is opened and closed by a control signal from control apparatus 4. An air supply source 5 is connected to valve 3 for operating gun 1. A pneumatic/hydraulic converter 13 converts air pressure into liquid pressure. A flow control valve 14 is connected between converter 13 and gun 1 by a fluid line or circuit 12.

In the system shown in FIG. 1 dispensing gun 1 and substrate material 6 move relative to one another. Dispensing gun 1 moves relative to substrate material 6 or substrate material 6 moves relative to dispensing gun 1 using a robot apparatus or the like which can move along the X axis and Y axis. In a liquid dispense-coating apparatus constituted in this manner, when a control signal is received from control apparatus 4 and solenoid operated valve 3 opens, operating air from air supply source 5 is supplied to pneumatic/hydraulic converter 13, and energy is converted from air pressure to liquid pressure. The converted liquid pressure is supplied from pneumatic/hydraulic converter 13 to cylinder unit 1*a*, which constitutes the hydraulic actuator of dispensing gun 1, via flow control valve 14 provided in hydraulic supply circuit 12. When this happens, piston 7 is pushed upward against the pressure of spring 8. Needle 9, which constitutes the valve mechanism of dispensing gun 1, is directly linked to piston 7, so it is pulled upward at the same time and the valve mechanism opens.

Liquid 11 supplied from liquid supply apparatus 2 is dispensed from nozzle 10 when needle 9 opens, and the liquid is coated in a line 11 on the surface of substrate material 6, which moves relative to dispensing gun 1. When coating ends, solenoid operated valve 3 is switched by a control signal from control apparatus 4, and the air pressure supplied to pneumatic/hydraulic converter 13 is released and becomes atmospheric pressure. The liquid pressure pushing piston 7 upward is also released and returns to pneumatic/hydraulic converter 13 through flow control valve 14 provided in liquid pressure supply circuit 12. Piston 7 is then pushed down by the force of spring 8, and needle 9 closes to stop the dispensing of liquid 11. Thus, the speed of the opening action and closing action of needle 9 can be freely regulated by regulating flow control valve 14.

Before an actual coating operation takes place, a number of tests are carried out while regulating flow control valve 14 to match coating parameters, such as the physical properties of the coating liquid, and to determine the valve mechanism opening speed at which bubbles do not form at the coating start point, and to determine the valve mechanism closing speed at which there is not a sudden increase in dispensing amount at the coating end point. By adjusting and setting the flow control valve to a suitable speed it is possible to prevent the formation of bubbles at the coating start point and to prevent a sudden increase in dispensing amount at the coating end point.

Figure 2:
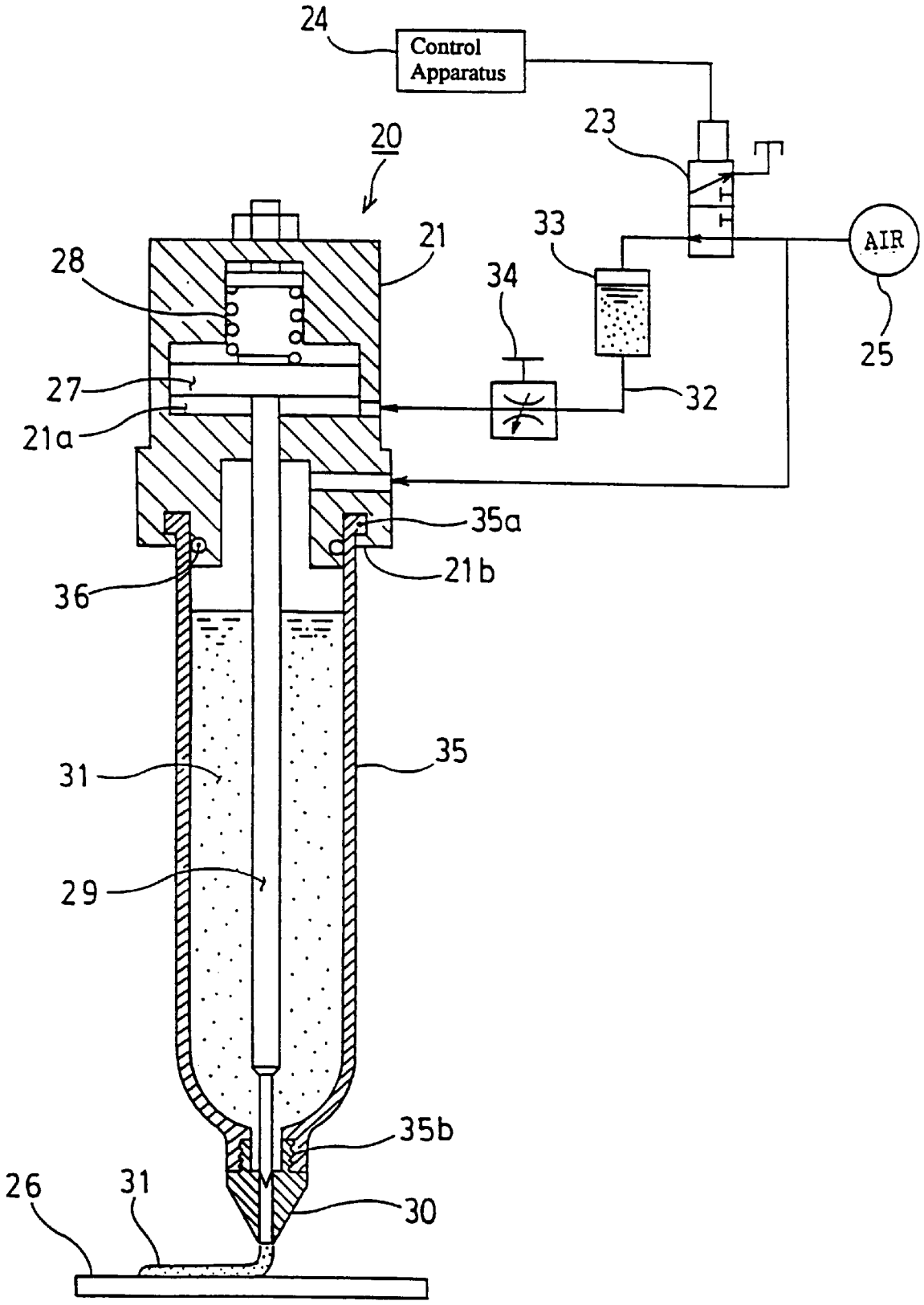
FIG. 2 is a schematic, partially cross-sectioned view of a second embodiment of the present invention.

The second embodiment, shown in FIG. 2, applies to a type of dispenser which is provided with a liquid already loaded into a chamber called a syringe or cartridge. In the embodiment shown in FIG. 2, a dispensing gun apparatus 20 and a substrate material 26 can move relative to one another. For example, the dispensing gun apparatus 20 moves relative to substrate material 26 or substrate material 26 moves relative to dispensing gun apparatus 20 by means of a robot device, not shown, which can move along the X axis and Y axis.

A solenoid operated valve 23 controls primary on/off air for opening and closing the valve mechanism of dispensing gun apparatus 20. Solenoid operated valve 23 is opened and closed by a control signal from a control apparatus 24. An air supply source 25 is connected to valve 23. A pneumatic/hydraulic converter 33 converts air pressure into liquid pressure, and provides pressurized liquid to a flow control valve 34.

Cylinder unit 21*a*, which constitutes a hydraulic actuator, is provided in a body 21 of dispensing gun apparatus 20, and a piston 27 is housed inside cylinder unit 21*a*. A chamber 35, generally referred to as a syringe or cartridge, is preloaded with liquid 31. Flange unit 35*a* is provided in the upper part of chamber 35; it is partially cut out in the circumferential direction. Meanwhile, catch unit 21*b* is provided in gun body 21 to correspond to flange unit 35*a* of chamber 35 and part is cut out in the circumferential direction. Chamber 35 is attached to gun body 21 by inserting flange unit 35*a* into catch unit 21*b* and rotating it a specified amount. A seal 36 made of an elastic body is provided as shown.

A screw unit 35*b* is provided in the tip of chamber 35, and a nozzle 30 is screwed onto screw unit 35*b*. The valve mechanism of gun 20 is constituted by nozzle 30 and the tip of a needle 29 mounted on the aforesaid piston 27. A spring 28 presses piston 27 downward.

In a liquid dispense-coating apparatus constituted in this manner, when a control signal is received from control apparatus 24 and solenoid operated valve 23 opens, operating air from air supply source 25 is supplied to pneumatic/hydraulic converter 33, and energy is converted from air pressure to liquid pressure. The converted liquid pressure is supplied from pneumatic/hydraulic converter 33 to cylinder unit 21*a*, which constitutes the hydraulic actuator of dispensing gun apparatus 20, via flow control valve 34 provided in hydraulic supply circuit 32. When this happens, piston 27 is pushed upward against the pressure of spring 28. Needle 29, which constitutes the valve mechanism of dispensing gun apparatus 20, is directly linked to piston 27, so it is pulled upward at the same time and the valve mechanism opens. Then liquid 31, which was previously loaded into chamber 35, is constantly pressurized by the pressurized air from air supply source 25, so it is dispensed from nozzle 30 by the valve mechanism opening action, and coated in a line 31 on the surface of substrate material 26, which moves relative to dispensing gun apparatus 20.

When coating ends, solenoid operated valve 23 is switched by a control signal from control apparatus 24, and the air pressure supplied to pneumatic/hydraulic converter 33 is released and becomes atmospheric pressure. The liquid pressure pushing upwardly on piston 27 is also released and returns to pneumatic/hydraulic converter 33 through flow control valve 34 provided in liquid pressure supply circuit 32. Piston 27 is pushed down by the force of spring 28, and needle 29 closes the valve mechanism to stop the dispensing of liquid 31. The speed of the opening action and closing action can be freely regulated by regulating flow control valve 34.

Figure 3:
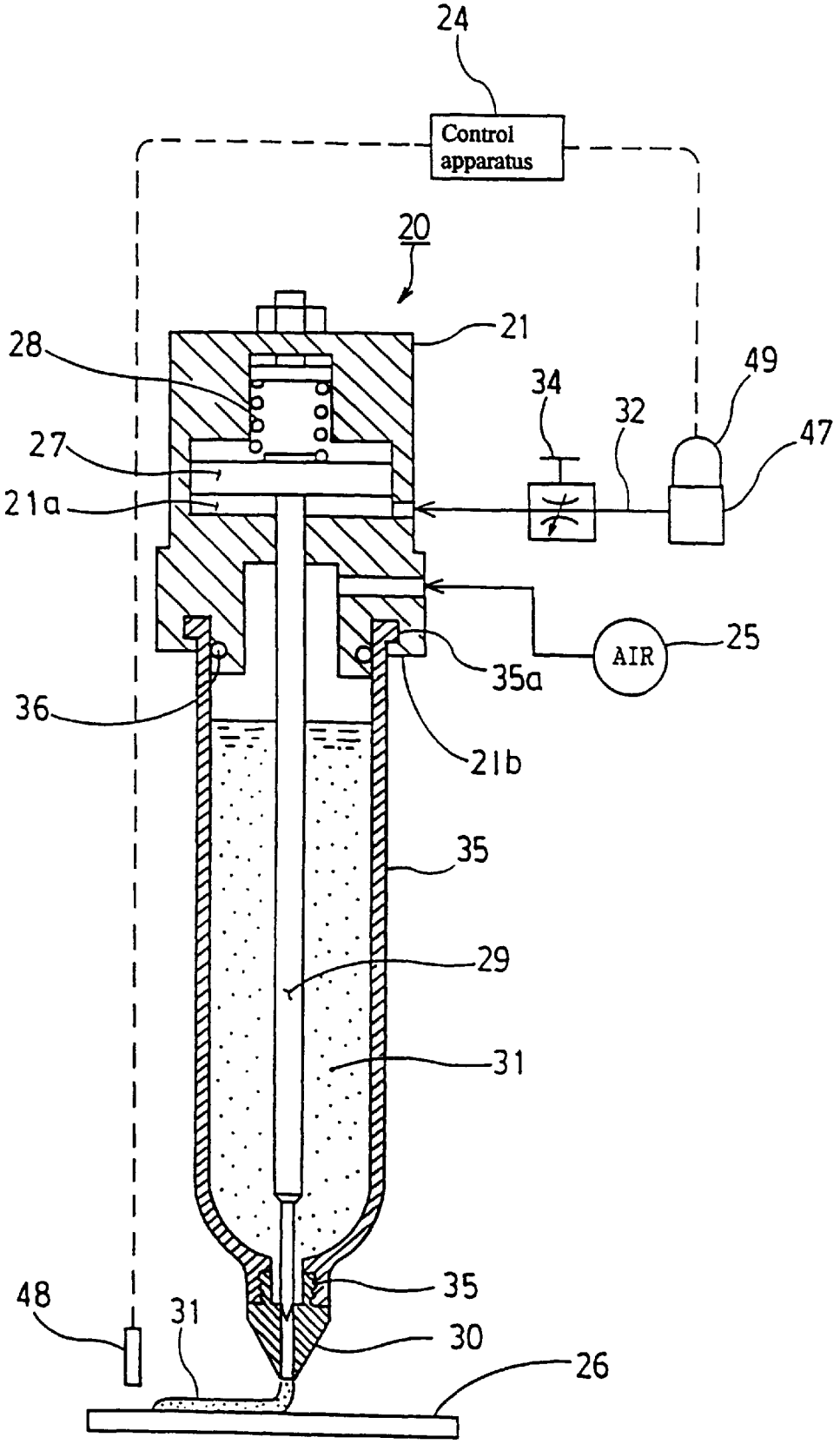
FIG. 3 is a schematic, partially cross-sectioned view a third embodiment of the present invention.
Figure 4:
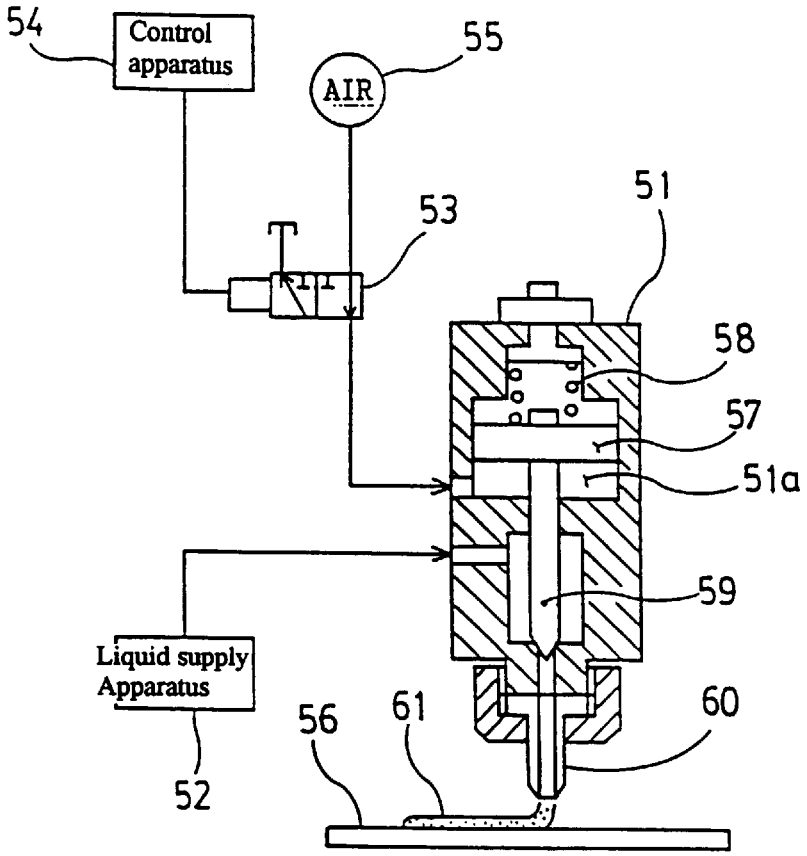
FIG. 4 is a schematic, partially cross-sectioned view of a conventional liquid coating apparatus.
Figure 5:
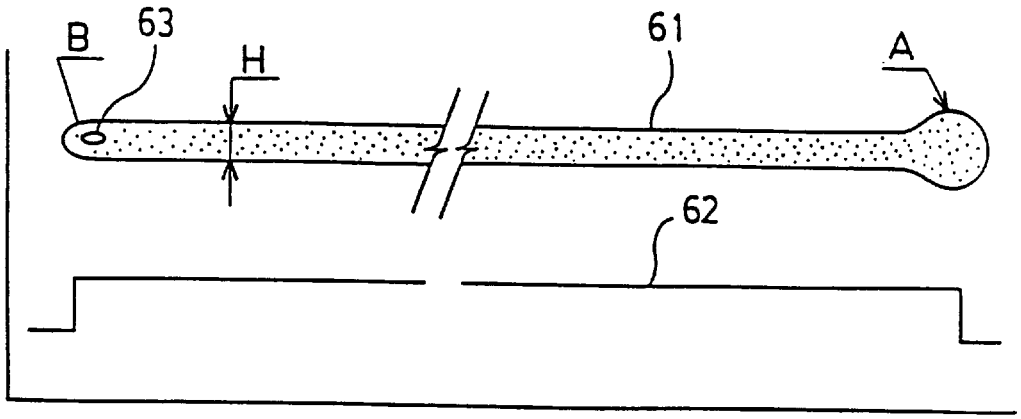
FIG. 5 illustrates the relationship between the valve mechanism opening and closing timing and coating pattern in a conventional coating method.

The third embodiment, shown in FIG. 3, is one which uses a liquid pressure supply apparatus capable of variable volume control. That is, instead of solenoid operated valve 23 and pneumatic/hydraulic converter 33 in the second embodiment, the third embodiment provides liquid pressure supply apparatus 47, which is capable of variable volume control, and also provides speed detection apparatus 48, which detects the relative motion speed of substrate material 26 and dispensing gun apparatus 20. In other respects, this embodiment is essentially the same as the second embodiment. Therefore, constituent units which have the same function as in the second embodiment are given the same reference numbers, and detailed discussion thereof shall be omitted.

Liquid pressure supply apparatus 47 uses stepping motor 49, and functions so that the liquid pressure supply amount can be variably controlled in proportion to a pulse signal which is the control signal from control apparatus 24. In a liquid dispense-coating apparatus constituted in this manner, when a relative motion speed signal between dispensing gun apparatus 20 and substrate material 26 detected by speed detection apparatus 48 is introduced to control apparatus 24 as the input signal, it is incremented by an addition function of control apparatus 24, and a pulse signal proportional to speed is output to stepping motor 49, and stepping motor 49 is controlled. By doing so, a liquid pressure volume proportional to relative motion speed is supplied from liquid pressure supply apparatus 47 to cylinder unit 21*a* via flow control valve 34 provided in liquid pressure supply circuit 32. When this happens, piston 27 is pushed upward against the pressure of spring 28 only by the supplied amount of liquid pressure volume.

Needle 29 is directly linked to piston 27 so it is pulled upward at the same time only by the amount of liquid pressure, and the valve mechanism also is opened only by the liquid pressure amount. Liquid 31, which was previously loaded into chamber 35, is then constantly pressurized by the pressurized air from air supply source 25, so it is dispensed from nozzle 30 by the valve mechanism opening action, and coated in a line 31 on the surface of substrate material 26 which moves relative to dispensing gun apparatus 20.

When the pulse signal from control apparatus 24 diminishes in proportion to relative speed, only the diminished amount of liquid pressure in cylinder 21*a* returns to the liquid pressure supply apparatus from cylinder unit 21*a*, and the extent to which the valve mechanism opens is regulated. By doing so, the amount of liquid 31 dispensed also diminishes. That is, by regulating the extent to which the valve mechanism opens in proportion to the relative motion speed of the dispensing gun apparatus and substrate material and by regulating the amount of liquid dispensed, it is possible to maintain a constant coating line width even if the relative motion speed of the dispensing gun apparatus and substrate material changes.

Furthermore, in the third embodiment a relative motion speed signal between dispensing gun apparatus 20 and substrate material 26 detected by speed detection apparatus 48 is introduced to control apparatus 24 as the input signal, but instead of this it is possible to introduce a relative motion signal from a robot device (not shown in the drawing) which can move along the X axis and Y axis, etc., as the input signal.

The embodiments described above are preferred embodiments, and a person with skill in the relevant art could easily modify them to other configurations without departing from the scope of the present invention. The important thing in the embodiments is that a hydraulic actuator is used to open and close the valve mechanism in the dispensing gun or dispensing gun apparatus; otherwise, their constitution can be freely modified. For example, they could be easily combined with the constitution disclosed in the previously discussed Examined Utility Model Application Hei 7-33907 or with other known constitutions. Therefore the scope of the present invention should be defined only by the claims.

I claim:

1. Apparatus for dispensing a liquid, the apparatus comprising:

a dispensing gun having a body, a valve mechanism disposed in said body and operable between opened and closed positions for selectively dispensing liquid from said gun, a piston mounted for reciprocating movement and operatively coupled with said valve mechanism, a hydraulic actuator operatively coupled to said piston for moving said piston in response to hydraulic pressure, and a flow control device operatively coupled between said hydraulic actuator and said piston for regulating hydraulic fluid flow delivered from said hydraulic actuator and acting on said piston and thereby controlling a speed of movement of said valve mechanism between said open and closed positions.

2. The apparatus of claim 1 further comprising a spring return mechanism operatively coupled to said piston for returning said valve mechanism to the closed position.

3. The apparatus of claim 1, wherein said hydraulic actuator further comprises a pneumatic to hydraulic pressure converter that receives an input of air pressure and outputs a corresponding liquid pressure.

4. The apparatus of claim 1, wherein said flow control device further comprises a flow regulating valve.

5. The apparatus of claim 1, wherein the gun body further comprises a pre-loaded chamber of liquid to be dispensed when said valve mechanism is in the opened position.

6. The apparatus of claim, 1, wherein said hydraulic actuator further comprises a pressurized hydraulic fluid supply having a pressurized output controlled by a motor.

7. The apparatus of claim 6 further comprising:

a sensor for sensing a relative speed of motion between the dispensing gun and a substrate to be coated, said sensor being operatively coupled to said motor so that the output of said pressurized hydraulic fluid supply is controlled in proportion to said relative speed of motion.

8. The apparatus of claim 1, further comprising:

a sensor for sensing a relative speed of motion between the dispensing gun and a substrate to be coated, said sensor being operatively coupled to said hydraulic actuator so that the output of said hydraulic pressure is controlled in proportion to said relative speed of motion.

9. A method of dispensing liquid from a gun including a valve mechanism said valve mechanism operatively coupled to a piston, said valve mechanism being disposed in a liquid passage of said gun and movable between opened and closed positions under the force of hydraulic pressure from a hydraulic fluid, the method comprising:

holding a supply of pressurized liquid in the liquid passage, moving the piston under the force of the hydraulic pressure to thereby move said valve mechanism from said closed position to said opened position, adjusting the force of said hydraulic pressure by varying a flow of the pressurized hydraulic fluid against said piston and thereby varying a speed of movement of said valve mechanism to at least one of said opened and closed positions, and dispensing said pressurized liquid.

10. The method of claim 9, wherein the dispensing gun further includes a spring mechanism for urging said valve mechanism to said closed position, and the method further comprises:

reducing the force of said hydraulic pressure, and returning said valve mechanism to said closed position under a force of said spring mechanism to stop dispensing said pressurized liquid.

11. The method of claim 9, wherein the step of holding said pressurized liquid further comprises holding said pressurized liquid in a pre-loaded, pressurized chamber.

12. The method of claim 9, wherein the step of moving said piston under the force of said hydraulic pressure further comprises:

introducing a pneumatic pressure into a pneumatic to hydraulic pressure converter, and outputting said hydraulic pressure from said pressure converter.

13. The method of claim 9, wherein the pressurized liquid is dispensed onto a substrate having a relative speed of movement with respect to said dispensing gun, and the method further comprises:

sensing said relative speed of movement, and controlling the force of said hydraulic pressure in proportion to the sensed relative speed of movement.

14. A method of dispense-coating a surface of a substrate with liquid from a valve mechanism of a dispensing gun operated by a hydraulic actuator operatively coupled with a flow control device, the method comprising:

discharging pressurized hydraulic fluid from said hydraulic actuator to open said valve mechanism and thereby dispense said liquid onto the substrate, and adjusting the flow of said pressurized hydraulic fluid from said hydraulic actuator to vary at least one of an opening extent, an opening speed and a closing speed of said valve mechanism.

15. The method of claim 14 further comprising:

controlling the flow of said pressurized hydraulic fluid in proportion to a relative speed of movement between said dispensing gun and said substrate.

16. The method of claim 14 further comprising:

sensing said relative speed of movement, and varying the flow of said pressurized hydraulic fluid in proportion to the sensed relative speed.

* * * * *

UNITED STATES PATENT AND TRADEMARK OFFICE

CERTIFICATE OF CORRECTION

PATENT NO. : 6,060,125
DATED : May 9, 2000
INVENTOR(S) : Hidetsugu Fujii

It is certified that error appears in the above-identified patent and that said Letters Patent is hereby corrected as shown below:

Column 2,
Line 42, change "substrate'scombined" to -- substrate's combined --.

Column 3,
Line 32, change "mechanism'sextent" to -- mechanism's extent --.

Column 4,
Line 56, after "view" insert -- of --.

Column 5,
Line 2, after "apparatus" insert -- 2 --.

Column 8,
Line 47, after "mechanism" insert -- , --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*